United States Patent [19]

Wade

[11] Patent Number: 4,924,840

[45] Date of Patent: May 15, 1990

[54] FAST RESPONSE EXHAUST GAS RECIRCULATION (EGR) SYSTEM

[75] Inventor: Wallace R. Wade, Farmington Hills, Mich.

[73] Assignee: Ford Motor Company, Dearborn, Mich.

[21] Appl. No.: 253,523

[22] Filed: Oct. 5, 1988

[51] Int. Cl.[5] ..... F02M 25/06

[52] U.S. Cl. ..... 123/571; 123/568

[58] Field of Search ..... 123/568, 571, 399

[56] References Cited

U.S. PATENT DOCUMENTS

| | | | |
|---|---|---|---|
| 2,354,179 | 7/1944 | Blanc | 123/568 |
| 2,741,233 | 4/1956 | McKinley | 123/568 X |
| 3,954,091 | 5/1976 | Stumpp | 123/568 |
| 4,027,636 | 6/1977 | Yamamoto et al. | 123/568 |
| 4,173,205 | 11/1979 | Toelle | 123/571 |
| 4,224,912 | 9/1980 | Tanaka | 123/568 |
| 4,233,946 | 11/1980 | Yorioka et al. | 123/568 |
| 4,282,846 | 8/1981 | Minoura | 123/568 |
| 4,473,056 | 9/1984 | Ishida et al. | 123/571 |
| 4,674,464 | 6/1987 | Akagi | 123/571 |
| 4,690,120 | 9/1987 | Egle | 123/571 |
| 4,691,676 | 9/1987 | Kikuchi | 123/399 |
| 4,708,316 | 11/1987 | Cook | 123/571 X |
| 4,721,089 | 1/1988 | Currie et al. | 123/571 |

*Primary Examiner*—Willis R. Wolfe

*Attorney, Agent, or Firm*—Jerome R. Drouillard; Clifford E. Sadler

[57] ABSTRACT

An exhaust gas recirculation (EGR) system and construction is provided in which an EGR flow valve and an air flow valve are mounted on a common shaft or, alternatively, interconnected by stepper motors or electric motors to ensure equal response times for the flow of EGR gases and air flow into the engine combustion chamber. In one embodiment, a secondary EGR valve is provided in the EGR passage to bleed the exhaust back pressures to approximately atmospheric level to equal that of the air being inducted past a main air throttle valve. Finally, an EGR control system is provided for calculating the EGR flow rate as to be able to set the spark timing of the engine according to previously determined mapping data that provides values required for best fuel economy at any EGR rate.

5 Claims, 3 Drawing Sheets

$$\Delta P_{\substack{AIR \\ THROTTLE}} = \Delta P_{\substack{EGR \\ VALVE}}$$

$$\frac{W_{EGR}}{W_{AIR}} = \frac{A_{EGR}}{A_{AIR}}$$

FAST RESPONSE EXHAUST GAS RECIRCULATION (EGR) SYSTEM

This invention relates in general to an EGR system for an automotive type internal combustion engine.

More particularly, it relates to one in which the flow of exhaust gases through the EGR system is as fast in response time to depression of the vehicle accelerator pedal as the air flow into the engine upon opening of the main throttle valve so that the air/fuel ratio of the charge inducted into the engine can be more accurately controlled.

Current gasoline engines for passenger cars and light trucks operate at a stoichiometric air/fuel ratio for most of the engine operating range. This air/fuel ratio is desired to minimize the oxygen concentration in the exhaust so that the three-way catalyst can reduce HC, CO and $NO_x$ emissions simultaneously to meet legislated exhaust emission requirements. Improvements in fuel economy of 3 to 5% can be achieved by increasing the burn rate of these engines and by using high rates of exhaust gas recirculation EGR. High burn rates are required to ensure high thermal efficiency with the highly dilute mixtures. High rates of EGR are required to reduce pumping losses due to throttling of the engine, and to reduce heat losses by the reduction of the peak combustion gas temperatures.

High burn rates commonly are provided by the use of swirl blades in the intake port or with the use of a divided port with a control valve to close off one side of the port for low-speed engine operation.

High rate EGR systems, however, introduce potential problems during transient operation. The control system must be designed to resolve these potential problems with the following techniques: (1) the EGR valve must act as fast as the accelerator pedal-actuated air throttle to ensure that the EGR and air flow are synchronized; and (2) accurate measurement of the EGR rate is required to provide a feedback signal to the EGR control system and for the calculation of the correct spark timing for correct burn rate.

Current EGR control systems using vacuum actuated valves and a measurement of the pressure drop across the EGR flow orifice to schedule EGR flow may not be suitable for high rate EGR systems for the following reasons: (1) the response time of vacuum actuated EGR valves is as long as 200–300 msec; in contrast, the accelerator pedal-actuated air throttle can fully open in 50 msec and as a result, EGR rates would lag significantly behind the air flow rates; and (2) the EGR flow rate measurement derived from the pressure drop across the EGR flow orifice does not accurately reflect the amount of EGR entering the engine since there is a significant transport lag from the EGR measurement location to the engine intake ports.

The EGR control of the invention to be described provides the fast EGR response times that overcome the limitations of current EGR control systems to provide the desired high rate of EGR at the desired engine operating conditions.

It is a primary object of the invention, therefore, to provide an EGR system in which the EGR valve is opened by a stepper motor or electric motor concurrent with an opening movement of the accelerator pedal controlled throttle valve to ensure equal response times for the air flow and EGR flow.

The use of stepper motors or electric DC motors controlling the movement of an EGR valve are known. For example, Toelle, U.S. Pat. No. 4,173,205. discloses a closed loop EGR system wherein a stepper motor 125 (FIG. 6) rotates shaft 126 incrementally to open or close a butterfly type EGR valve 123 in response to manifold absolute pressure.

Akagi. U.S. Pat. No. 4,674,464. shows an EGR system characterized by a stepper motor driven EGR poppet valve 15 in response to the signal pulses from a computer 56.

Egle, U.S. Pat. No. 4,690,120, shows a similar control by a stepper motor 38.

Ishida et al. U.S. Pat. No. 4,473,056, describes the use of an electric motor 4 operated EGR valve.

Currie et al, U.S. Pat. No. 4,721,089, is directed to an EGR system wherein opening of the EGR valve 12 is controlled by a stepper motor in response to signals from computer 13. A control computer includes a program for controlling the fuel supply and the EGR valve in response to values of engine operating parameters from engine speed sensor 15, mass air flow center 17, throttle position sensor 18, and combustion pressure sensors.

Cook, U.S. Pat. No. 4,708,316, discloses a stepper motor (FIG. 2) driven EGR valve wherein air at atmospheric pressure is permitted to bleed into upper housing member 34 to prevent vacuum build-up.

The above prior art does not show or describe constructions in which the EGR valve and main throttle valve are interconnected in a manner to be operated essentially simultaneously, or with a predetermined lag therebetween, and either by stepper motors or electric motors, and designed to provide the correct air flow and EGR flow to the engine.

Other objects, features and advantages of the invention will become more apparent upon reference to the succeeding, detailed description thereof, and to the drawings illustrating the preferred embodiments thereof; wherein:

FIG. 1 schematically illustrates a cross-sectional view of a portion of an internal combustion engine embodying the invention;

FIG. 1A graphically illustrates the ratio of EGR flow to air flow;

Figure 1:
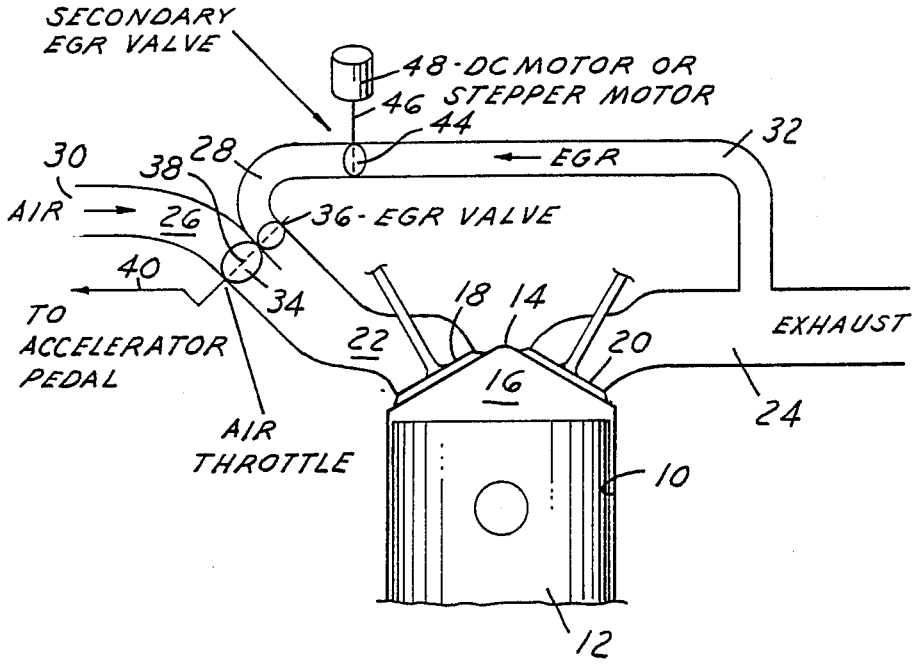
Figure 1A:
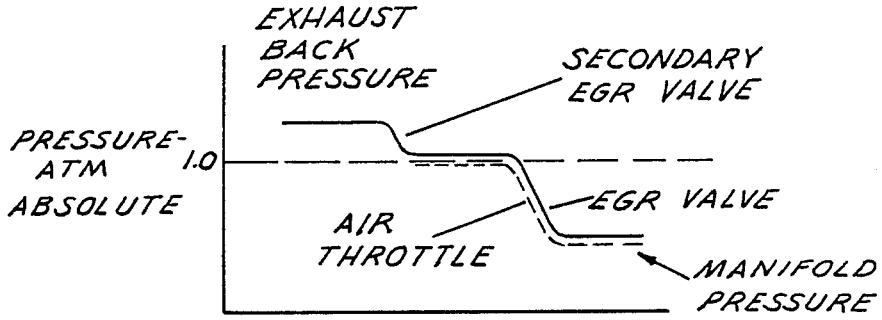

FIG. 1 illustrates schematically the induction and exhaust systems for an automotive type internal combustion engine having a plurality of cylinders 10, only one being shown, for clarity. The cylinder contains the usual reciprocating piston 12 together with a cylinder head 14 forming a combustion chamber 16. A pair of intake and exhaust valves 18, 20 control, respectively, the induction of an air/fuel charge into the combustion chamber from an induction passage 22, and a discharge of exhaust gases into the exhaust system to a conduit 24.

Induction passage 22 is bifurcated at its upper end to form a pair of branch Passages 26, 28. Passage 26 is an air induction passage open at its upper end 30 to ambient air from a conventional air cleaner, for example. Passage 28, on the other hand, is smaller in cross-sectional area and is connected to an EGR passage 32 connected as shown to the exhaust conduit or passage 24. This will provide for a controlled volume of flow of exhaust gases into EGR passage 32 for subsequent passage into the engine combustion chamber via the induction passage 22, to control the $NO_x$ emissions, as well as the air/fuel ratio of the induction charge.

Flow of air and EGR gases into the engine is controlled by a pair of butterfly type valves 34 and 36, in this case, mounted on a common shaft 38. A common shaft ensures equal response times for the flow of air and EGR. The EGR valve 36 in this case is of a smaller diameter than that of the air flow control throttle valve 34, so as to provide the proper percentage of EGR flow to air flow to maintain the desired mixture flow into the engine to control burn rates, etc. The common shaft 38 is shown as being linked by any suitable means 40 to the vehicle accelerator pedal so as to be opened and closed by the vehicle operator in a known manner.

Also shown in the EGR passage 32 is a secondary butterfly type EGR valve 44 mounted on a shaft 46 projecting from a motor 48. The latter as a matter of choice can be a known type of DC electric motor or stepper motor for incrementally changing the rotative position of the secondary EGR valve 44 to control in this case the pressure in the EGR passage 32. The DC motor or stepper motor is used to actuate the EGR valve with a response time as fast as the air throttle valve, which is approximately 50 msec from idle to maximum open position.

The secondary EGR valve 44 is used to control a bleed of air into the EGR passage 32 downstream of the valve in the branch passage portion 28 to decay the exhaust back pressure to a level equalizing the pressure in the air flow branch passage 26. While not shown, the details of construction and operation for bleeding air into the passage could be as that shown and described by Cook in U.S. Pat. No. 4,708,316, incorporated herein by reference. At low exhaust backpressures in EGR passage 32; i.e., near to atmospheric, no bleeding of the pressure of the exhaust gases is necessary since the system will provide nearly equal EGR rates (EGR flow as a percentage of the air flow) to the engine at all conditions. FIG. 2A shows the ratio of EGR flow to air flow as a function of the ratio of the area of the EGR valve 36 to the area of the air throttle valve 34.

When the exhaust backpressure in EGR passage 32 is higher, the secondary EGR valve 44 can be actuated to bleed pressure from the system by the use of the stepper motor 48 to reduce exhaust pressure to essentially atmospheric pressure level. With atmospheric exhaust Pressure upstream of the EGR valve 36, the ratio of EGR flow to air flow will be a function of the ratio of the area of the EGR valve 36 to the area of the air throttle valve 34, as described previously in connection with operation at low back pressure levels.

As stated previously, the DC motor or stepper motor 48 is used to actuate the secondary EGR valve 44. For a more precise control of the exhaust pressure upstream of the primary EGR valve 36, an EGR pressure transducer (not shown) could be used to provide feedback to an onboard computer for the control of the secondary EGR valve 44 in a manner to provide the exact pressure desired of EGR flow past the primary EGR valve 36. If EGR rates are desired that are different from the geometric area ratio of the EGR and air throttle valves, the secondary EGR valve 44 can be used to modulate the EGR flow rate obtained with a common shaft EGR valve-air throttle.

Figure 2:
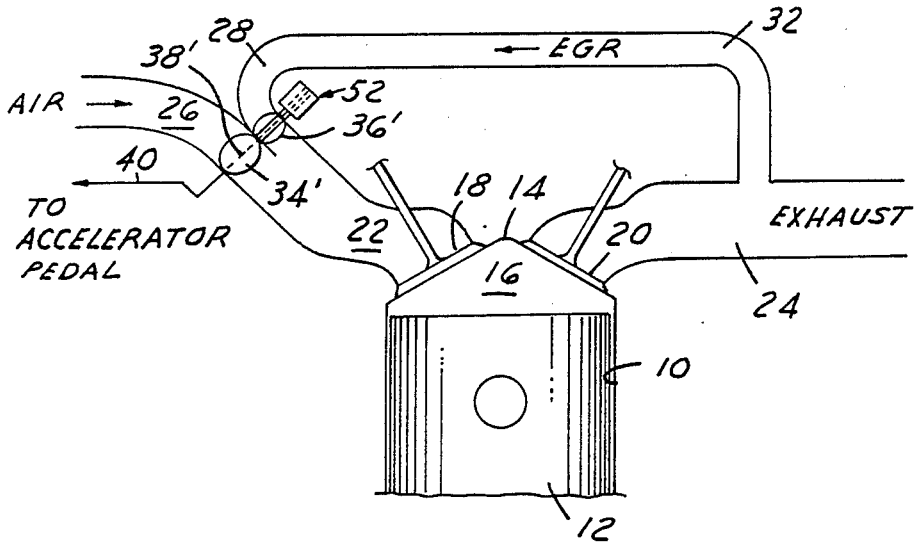
FIG. 2 illustrates another embodiment of the invention.
Figure 2A:
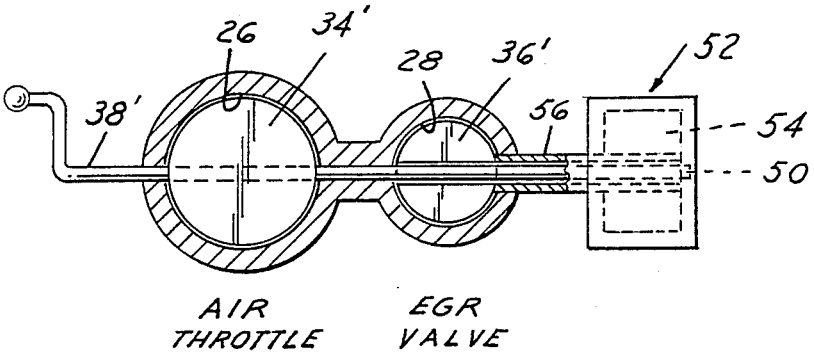
FIG. 2A is an enlarged cross-sectional view of a detail of FIG. 2.

FIGS. 2 and 2A show another embodiment of the invention in which the EGR valve 36' and main throttle valve 34' are mounted essentially on a common shaft, but interconnected through a DC electric motor or stepper motor so as to be able to change the ratio of EGR flow to air flow as desired. More specifically, FIG. 2A shows the common shaft 38' on which is fixedly mounted the main air throttle valve 34' within the branch induction passage 26. In this case, the throttle shaft 38' extends through the EGR throttle valve 36' to one part 50 of a DC electric motor or stepper motor indicated in general at 52. The other part for the motor 54 is fixed to a sleeve-type shaft 56 concentrically mounted about the main throttle shaft 38' and on which is fixed the EGR butterfly valve 36', as shown.

It will be clear from the construction described that both the EGR valve 36' and main air throttle valve 34 can be operated simultaneously to ensure that the EGR rate is equal to the geometric area ratio of the EGR and air throttle valves. It will also be clear, however, that the EGR valve being mounted to a DC motor or stepper motor and therefrom to the air throttle valve permits the ratio of the area of the opening of the EGR valve relative to the air throttle valve to be controlled to change the ratio incrementally as desired.

Figure 3:
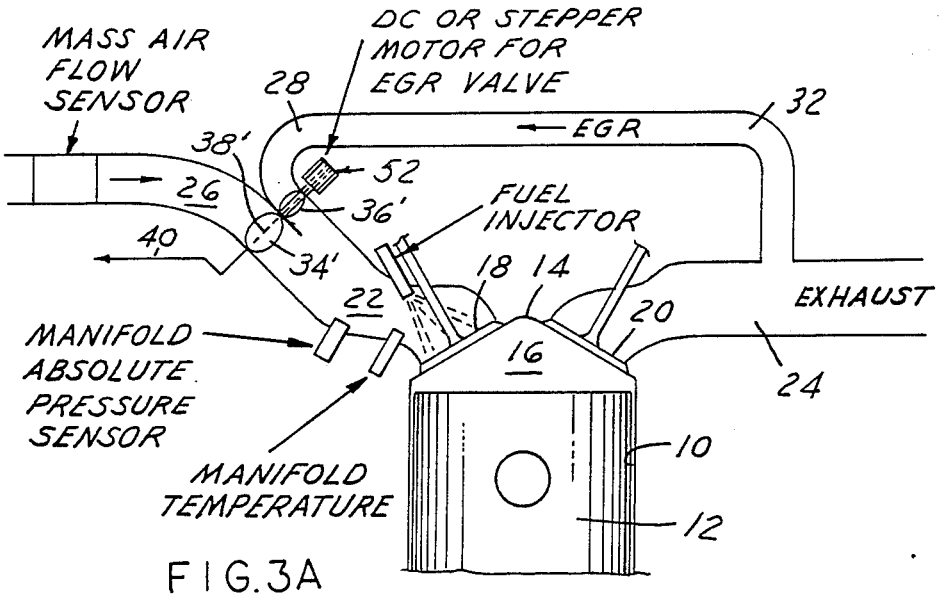
FIG. 3 illustrates a still further embodiment of the invention.
Figure 3A:
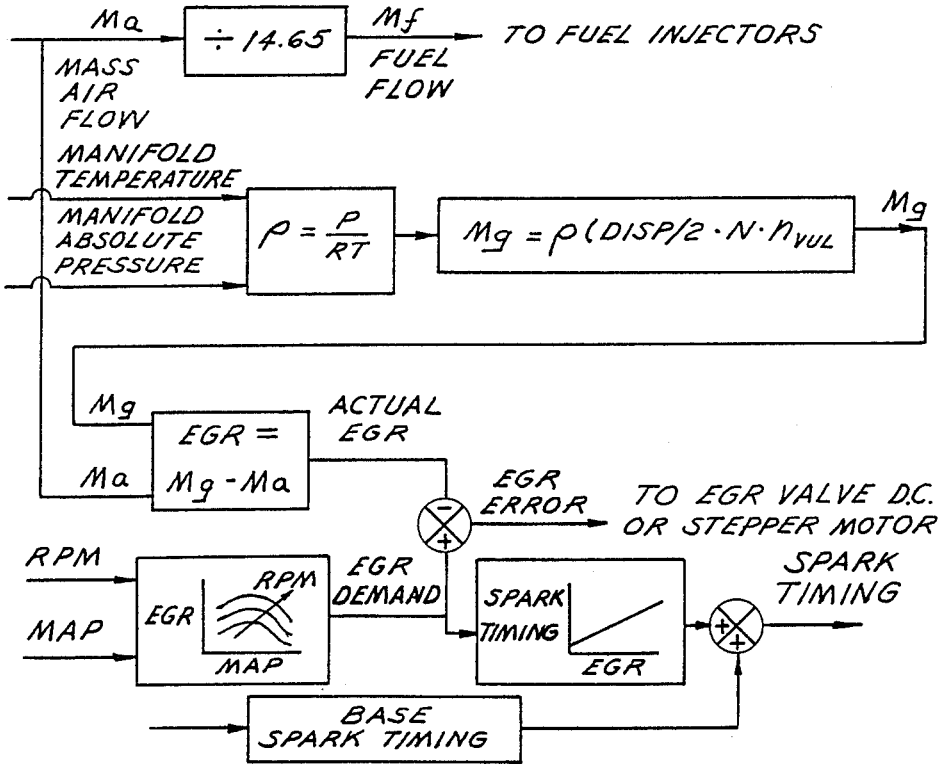
FIG. 3A illustrates in line diagram form a control system to determine the correct EGR flow rate.

FIGS. 3 and 3A illustrate schematically a control system to calculate the ultimate value of EGR flow for setting the spark timing according to previously determined mapping data, as well as other uses. More specifically, engine air flow is measured with a mass air flow sensor (MAFS). The desired stoichiometric air/fuel ratio is provided by dividing the air flow by 14.65 and using the resulting value to set the fuel flow through the fuel injectors.

Accurate control of EGR is provided by an accurate measurement/calculation of the EGR rate which is used as feedback for comparisons with the demanded EGR rate. A conventional closed-loop control system is subsequently used to control or to trim the EGR valve. The EGR rate is determined from the measured mass air flow rate and the gas charge rate determined from a speed density calculation. A manifold absolute pressure sensor (MAP), together with an intake charge temperature sensor, is used to determine the gas charge (air plus EGR) in the cylinder as follows:

$$\text{Charge density } \rho = \frac{P}{RT}$$

Where: $P$ = manifold absolute pressure
$T$ = intake charge temperature
$R$ = universal gas constant The gas charge flow rate is subsequently calculated as follows:

| | | |
|---|---|---|
| Where: | Mg | $= \rho$ (DISP/2).N.$\eta$ vol. |
| | Mg | = gas charge mass flow rate |
| | DISP | = engine displacement |
| | N | = engine speed |
| | $\eta$ vol | = volumetric efficiently |

The EGR rate is subsequently determined as follows:

Where: EGR = MG − MA

-continued

| | | |
|---|---|---|
| Ma | = | mass air flow measured with MAFS |

Since the manifold absolute pressure sensor provides the pressure in the manifold as the cylinder is being filled, this system provides nearly an instantaneous measurement/calculation of the EGR rate.

The measured/calculated actual EGR rate is then compared with the demanded EGR rate (FIG. 3A). The EGR valve is commanded to move to reduce an error which may exist between the demanded and calculated values of EGR.

The calculated value of EGR is subsequently used to set the spark timing according to previously determined mapping data. The mapping data provides the spark timing values required for best fuel economy at any EGR rate. The accurate measurement/calculation of the EGR rate is required to ensure that the spark timing for the best fuel economy is always provided (especially through transient operation).

From the foregoing, it will be seen that the invention provides an EGR control system and construction that will ensure equal response times for the flow of EGR gases and air into the engine to provide the correct air/fuel charge. Alternatively, varying ratios of air flow to EGR flow can be obtained by control of a secondary EGR valve or by the use of electric motors or stepper motors to vary the operation between the air throttle valve and EGR flow control valves.

While the invention has been shown and described in its preferred embodiments, it will be clear to those skilled in the arts to which it pertains that many changes and modifications may be made thereto without departing from the scope of the invention.

What is claimed:

1. An exhaust gas recirculation (EGR) control for an automotive type internal combustion engine comprising, a gas induction passage connected to the engine intake manifold at one end, an EGR passage connected at one end to exhaust gases from the engine combustion chamber, the other end of the induction passage being bifurcated to form ambient air and EGR branch passages, means connecting the ambient air branch passage to ambient air, means connecting the EGR branch passage to the other end of the EGR passage whereby ambient air and EGR gases combine to form a gas charge inducted into the engine, ambient air and EGR branch passage throttle valves movably mounted in their respective passages for variably controlling the flow therethrough, and mounting means mounting the throttle valves for concurrent movement to fix the ratio of EGR flow to ambient air flow at predetermined exhaust backpressure levels, with said exhaust gas recirculation control further comprising a second EGR throttle valve in the EGR branch passage upstream of the first mentioned EGR throttle valve, and means connected with the second EGR valve for venting to atmosphere the EGR passage downstream of the second EGR valve to equalize the pressures in the branch passages at predetermined exhaust gas backpressure levels.

2. An exhaust gas recirculation (EGR) control for an automotive type internal combustion engine comprising, a gas induction passage connected to the engine intake manifold at one end, an EGR passage connected at one end to exhaust gases from the engine combustion chamber, the other end of the induction passage being bifurcated to form ambient air and EGR branch passages, means connecting the ambient air branch passage to ambient air, means connecting the EGR branch passage to the other end of the EGR passage whereby ambient air and EGR gases combine to form a gas charge inducted into the engine, ambient air and EGR branch passage throttle valves movably mounted in their respective passages for variably controlling the flow therethrough, and mounting means mounting the throttle valves for concurrent movement to fix the ratio of EGR flow to ambient air flow at predetermined exhaust backpressure levels, the mounting means including a first rotatable shaft, means fixing the ambient air throttle valve on the shaft, a sleeve shaft coaxially rotatably mounted on the first mentioned shaft, drive means fixing the EGR valve to the sleeve shaft, and means interconnecting the shafts for a drive of one by the other.

3. An EGR control as in claim 5, including a second EGR throttle valve in the EGR branch Passage upstream of the first mentioned EGR throttle valve, and means connected with the second EGR valve for venting to atmosphere the EGR passage downstream of the second EGR valve to equalize the pressures in the branch passages at predetermined exhaust gas backpressure levels.

4. An EGR control as in claim 2, including a second EGR throttle valve in the EGR branch passage upstream of the first mentioned EGR throttle valve, and means connected with the second EGR valve for variably venting to atmosphere the EGR passage downstream of the second EGR valve to change the pressures in the branch passages at predetermined exhaust gas backpressure levels.

5. An EGR control as in claim 3, wherein the drive means comprises a stepper motor for variably controlling incrementally the movement of the sleeve shaft relative to the first shaft.

* * * * *